US007228082B1

(12) United States Patent
Davidson et al.

(10) Patent No.: US 7,228,082 B1
(45) Date of Patent: Jun. 5, 2007

(54) BELT FUSER HAVING A MULTI-TAP HEATING ELEMENT

(75) Inventors: Malcolm G. Davidson, Fairport, NY (US); Robert R. Tuchrelo, Williamson, NY (US); Nathan E. Smith, Hamlin, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/509,238

(22) Filed: Aug. 24, 2006

(51) Int. Cl.
*G03G 15/00* (2006.01)

(52) U.S. Cl. ..... 399/45; 399/67; 399/69; 399/70; 399/329

(58) Field of Classification Search ..... 399/45, 399/33, 67, 69, 70, 329
See application file for complete search history.

(56) References Cited

U.S. PATENT DOCUMENTS

| | | | | |
|---|---|---|---|---|
| 4,348,102 | A * | 9/1982 | Sessink | 399/68 |
| 4,355,225 | A | 10/1982 | Marsh | |
| 4,585,325 | A * | 4/1986 | Euler | 399/69 |
| 4,920,250 | A | 4/1990 | Urban | |
| 5,148,226 | A * | 9/1992 | Setoriyama et al. | 399/329 |
| 5,262,834 | A | 11/1993 | Kusaka et al. | |
| 5,350,896 | A | 9/1994 | Amico et al. | |
| 5,497,218 | A * | 3/1996 | Amico | 399/69 |
| 5,752,148 | A * | 5/1998 | Yoneda et al. | 399/329 |
| 6,185,383 | B1 * | 2/2001 | Kanari et al. | 399/45 |
| 6,327,444 | B1 * | 12/2001 | Hachisuga | 399/45 |
| 6,516,166 | B2 | 2/2003 | Sakakibara et al. | |
| 2005/0163523 | A1 | 7/2005 | Omata et al. | |
| 2005/0201783 | A1 * | 9/2005 | Kurotaka et al. | 399/329 |

OTHER PUBLICATIONS

Copending U.S. Appl. No. 11/398,147, filed Apr. 5, 2006, entitled "High Precision-Heating and Fusing Apparatus," by Bryan J. Roof et al.

* cited by examiner

*Primary Examiner*—David M. Gray
*Assistant Examiner*—Geoffrey T Evans
(74) *Attorney, Agent, or Firm*—Lloyd F. Bean, II

(57) ABSTRACT

A printing machine adapted to print an image on a plurality of different predefined sized sheets, including: means for selecting a sheet of a predefined size to be imaged; means for recording image; means for developing the image; means for transferring the image on the sheet; and a fuser for fusing the image onto the sheet, the fuser includes an endless belt having a plurality of predefined sized fusing areas being selectively activatable, and wherein the plurality of predefined sized fusing areas are arranged in a substantially parallel manner along a process direction of the belt; and means for activating one or more of the plurality of predefined sized fusing areas to correspond to one of the selected predefined sized sheet.

20 Claims, 4 Drawing Sheets

BELT FUSER HAVING A MULTI-TAP HEATING ELEMENT

BACKGROUND

This invention relates generally to electrostatographic reproduction machines, and particularly a fuser adapted to handle different paper widths.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet.

In order to fuse and fix the powder toner particles onto a copy sheet or support member permanently as above, it is necessary for the thermal fusing apparatus to elevate the temperature of the toner images to a point at which constituents of the toner particles coalesce and become tacky. This action causes the toner to flow to some extent onto the fibers or pores of the copy sheet or support member or otherwise upon the surface thereof. Thereafter, as the toner cools, solidification occurs causing the toner to be bonded firmly to the copy sheet or support member.

One approach to thermal fusing of toner images onto the supporting substrate is illustrated for example in U.S. Pat. No. 5,350,896 and U.S. Pat. No. 4,920,250. This approach involves passing the substrate with the unfused toner images thereon into nip contact between a pair of opposed roller members at least one of which is heated, and its temperature controlled at a desired high operating or fusing temperature level of about 350 degrees Fahrenheit. Another approach as disclosed for example in U.S. Pat. No. 4,355,225 involves radiant fusing in which the substrate with the unfused toner image thereon is passed without contact, through a radiantly heated channel formed in part by a radiant heat member. The radiant heat member maintains the channel temperature during run or operating periods at the desired high operating or fusing temperature of about 350 degrees Fahrenheit.

As is well known, when started up, each reproduction machine typically goes through a warm up phase during which the heated member of the fusing apparatus gradually warms up to where the fusing channel or fusing nip reaches and can be maintained at the high fusing temperature. After that, the machine can be activated to run a job reproducing images through a run or operating cycle. After one of such jobs, the machine may be idle (or even go into an idle or a "standby" mode), while waiting for the next reproduction job. Conventionally, an efficiency practice as disclosed for example in U.S. Pat. No. 4,920,250 has been to turn off the power supply upon entering a idle or standby mode, and to allow the temperature of the fusing nip or channel to drop to, and to then be controlled by restarting and shutting off the power supply, at a lower temperature level.

Consistent with such a conventional practice, environmentally sensitive and market place regulations, now call for office equipment, particularly electrostatographic reproduction machines, to be more energy efficient. Such environmental regulations or requirements for office products are covered in the United States under what is currently called the "Energy Star Program", and under various other similar programs in Europe and elsewhere. Such similar programs include "New Blue Angel" (Germany), "Energy Conservation Law" (Japan), "Nordic Swan" (North Europe), and "Swiss Energy Efficiency Label" (Switzerland).

Under the "Energy or Power Star Program" in the United States, several modes are defined for copiers or electrostatographic reproduction machines. These modes for example include the operating or copying mode, the standby mode, and the low-power or energy-saver mode. The low-power or energy-saver mode is the lowest power state a copier can automatically enter within some period of copier inactivity, without actually turning off. The copier enters this mode within a specified period of time after the last copy was made. When the copier is in this mode, there may be some delay before the copier will be capable of making the next copy. For purposes of determining the power consumption in this low-power mode, a company may choose to measure the lowest of either the energy-saver mode or the standby mode.

The copier or machine enters the standby mode when it is not in the operating or copying mode, but had just previously been in the operating mode. In the standby mode, the copier or machine is consuming less power than when the machine is in the operating mode but is ready to make a copy, and has not yet entered into the energy-saver mode. When the copier is in the standby mode, there will be virtually no delay before the copier is back in the operating mode and capable of making the next copy.

When the machine is in the low-power or energy-saver mode, these regulations call for the total power being consumed by the machine to be limited to no more than 125 watts, of which no more than 50 watts can be to the fusing apparatus. When the copier or machine experiences prolonged low-power or energy-saver mode periods, this level of limited power (50 watts) to the fusing apparatus usually is only sufficient to maintain the temperature of the fusing apparatus at a temperature that is significantly below the desired high and ready-to-run fusing temperature of about 350 degrees Fahrenheit.

Timely and satisfactory recovery from such a significantly low low-power or energy-saver mode temperature back to the desired high fusing temperature is ordinarily difficult. This is because once the temperature of a fusing apparatus starts to drop or fall, it acquires a thermal inertia which then makes reversal or recovery difficult. Unfortunately, the "power or energy star" regulations, have made such a concern a problem for conventionally designed and controlled fusing apparatus, by calling for the reproduction machine to fully recover from such a low-power or energy-saver mode temperature back up to the desired, high fusing temperature in 30 seconds or less.

There is provided a printing machine adapted to print an image on a plurality of different predefined sized sheets including system for selecting a sheet of a predefined size to be imaged; system for recording image; developer for developing the image; transfer system for transferring the image on said sheet; and a fuser for fusing the image onto said sheet, said fuser includes an endless belt having a plurality of predefined sized fusing areas being selectively activatable, and wherein the plurality of predefined sized fusing areas are arranged in a substantially parallel manner along a process direction of said belt; and controller for activating one or more of said plurality of predefined sized fusing areas to correspond to one of said selected predefined sized sheet.

BRIEF DESCRIPTION OF THE DRAWINGS

In the detailed description below, reference is made to the drawings, in which.

DETAILED DESCRIPTION

Figure 1:
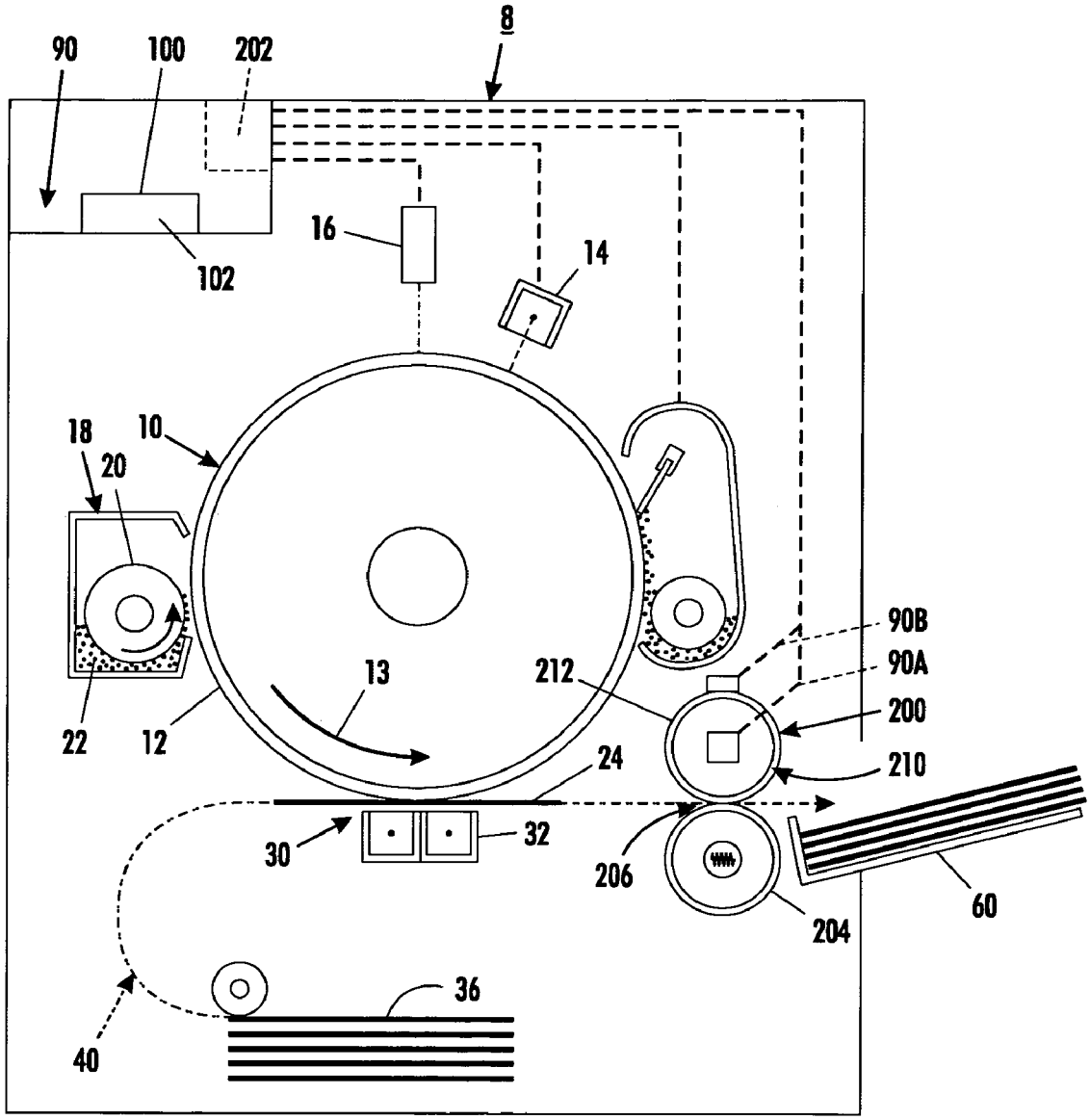
FIG. 1 is an elevational view showing relevant elements of an exemplary toner imaging electrostatographic machine including a first embodiment of the fusing apparatus of the present disclosure.

Referring now to FIG. 1, it is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 34 on which a desired image is to be printed is drawn from a sheet supply stack 36 and conveyed along a sheet path 40 to the transfer zone 30.

At the transfer zone 30, the print sheet 34 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 34. The print sheet 34 is then forwarded to subsequent stations, as is familiar in the art, including the fusing station having a high precision-heating and fusing apparatus 50 of the present disclosure, and then to an output tray 60. Following such transfer of a toner image from the surface 12 to the print sheet 34, any residual toner particles remaining on the surface 12 are removed by a toner image bearing surface cleaning apparatus 44 including a cleaning blade 46 for example.

As further shown, the reproduction machine 8 includes a controller or electronic control subsystem (ESS), indicated generally by reference numeral 90 which is preferably a programmable, self-contained, dedicated mini-computer having a central processor unit (CPU), electronic storage 102, and a display or user interface (UI) 100. At user interface (UI) 100 at user can select one of the plurality of different predefined sized sheets to be printed on. The ESS 90, with the help of sensors, a look up table 202 and connections, can read, capture, prepare and process image data such as pixel counts of toner images being produced and fused. As such, it is the main control system for components and other subsystems of machine 8 including the fusing apparatus 200 of the present disclosure.

Figure 2:
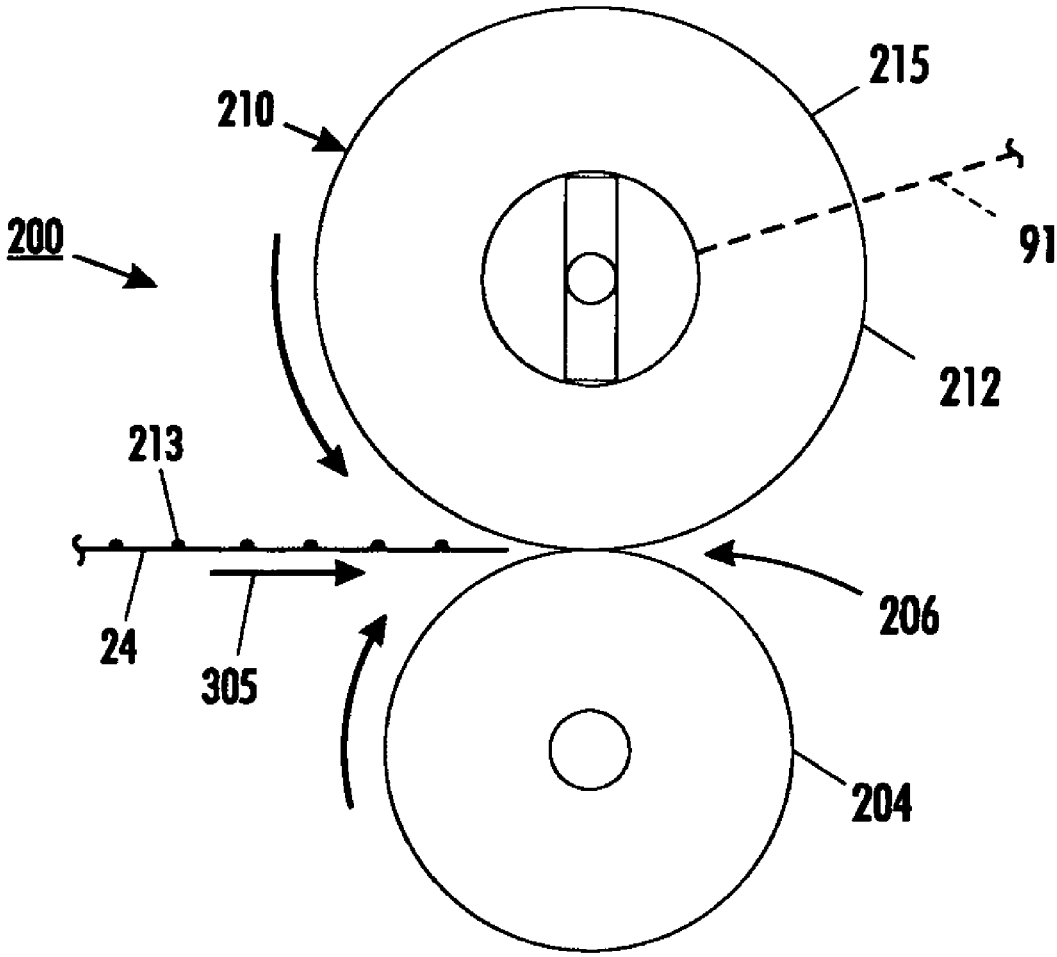
FIG. 2 is an enlarged schematic end view of an embodiment of the fusing apparatus of FIG. 1.
Figure 3:
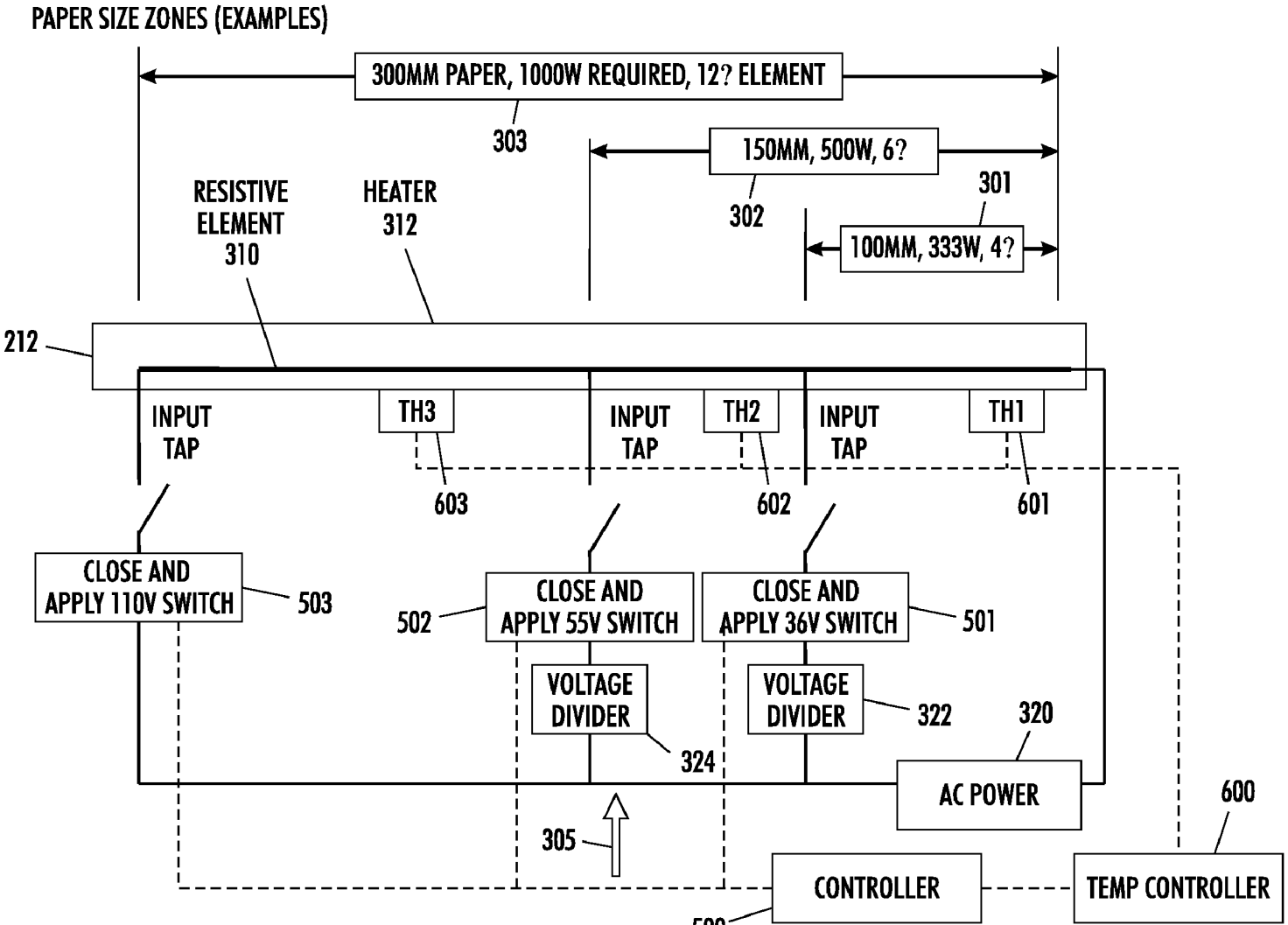
FIG. 3 is an enlarged schematic top view of the fusing apparatus showing an end-to-end series arrangement of the fuser belt in accordance with the present disclosure.

Referring now to FIG. 2, the fusing apparatus 200 of the present disclosure are illustrated in detail, and are suitable for uniform and quality heating of unfused toner images 213 in the electrostatographic reproducing machine 8. As illustrated, fusing apparatus 200 includes a rotatable pressure member 204 that is mounted forming a fusing nip 206. A copy sheets 24 carrying an unfused toner image 213 thereon can thus be fed through the fusing nip 206 for high quality fusing. As illustrated in FIG. 3, the fusing device 200 comprises an endless rotatable belt 212 and having a plurality of predefined sized fusing areas 301, 302 and 303 with each one of the fusing areas 301, 302 and 303 being selectively activatable by controller 300. Fusing areas 301, 302 and 303 are arranged in a substantially parallel manner along a process direction 305 of belt 212. Controller 300 activating one or more of fusing areas 301, 302 and 303 to correspond to sized sheet entering the fusing device 200. For example the width of fusing area 301 when activated may correspond to A4 sized paper while the width of predefined sized fusing area 302 when activated may correspond to A3; the width of predefined sized fusing area 303 when activated may correspond to A2 sized paper.

As further illustrated in FIG. 3, belt 212 further comprises a heating element 312 having a common resistive element 312 for output voltage in which the resistance varies with its length (for example: fusing area 303 total resistance is 12 ohms and 1000 watts is required to maintained fusing area 303 at a desired temperature; fusing area 302 total resistance is 8 ohms and 500 watts is required to maintained fusing area 302 at the same desired temperature; and: fusing area 301 total resistance is 4 ohms and 333 watts is required to maintained fusing area 302 at the same desired temperature). Belt 212 also includes a plurality of voltage input conductor taps 501, 502 and 503 along the length of belt in which the voltage input taps are selectively engaged which activates the predefined sized fusing areas 301, 302 and 303 that corresponds to the selected predefined sized sheet.

Power supply 320 supplies a voltage to each one voltage input taps 501, 502 and 503. Power supply supplies 320 each one voltage input taps 501, 502 and 503 a different predefine voltage uses voltage dividers 322 and 324 for input taps 501 and 502 respectively to obtained the same desired operating temperate in each predefined sized fusing areas 301, 302 and 303.

Temperature controller 600 controls the temperature in each predefined sized fusing areas 301, 302 and 303. Temperature controller includes temperature sensors 601, 602 and 603 associated with each predefined sized fusing areas 301, 302 and 303. Temperature controller, coacts with controller 500 and selectively activates one or more of predefined sized fusing areas 301, 302 and 303 in response to temperature sensors 601, 602 and 603 to maintain a constant temperature in one of said predefined sized fusing areas. Temperature sensors 601, 602 and 603 include thermistors for controlling power regulation associated with each predefined sized fusing areas 301, 302 and 303. For example in a possible control strategy all areas of the belt will be at a specified operating set point temperature, a thermistor would control the power regulation. For example if paper was running such that thermistor (TH2) was in control and TH3 (outside paper path) senses temperature dropping from set point, TH2 would be opened temporarily and TH3 would allow power to the entire element until it's satisfied, then it would be opened and TH2 would control again.

Figure 4:
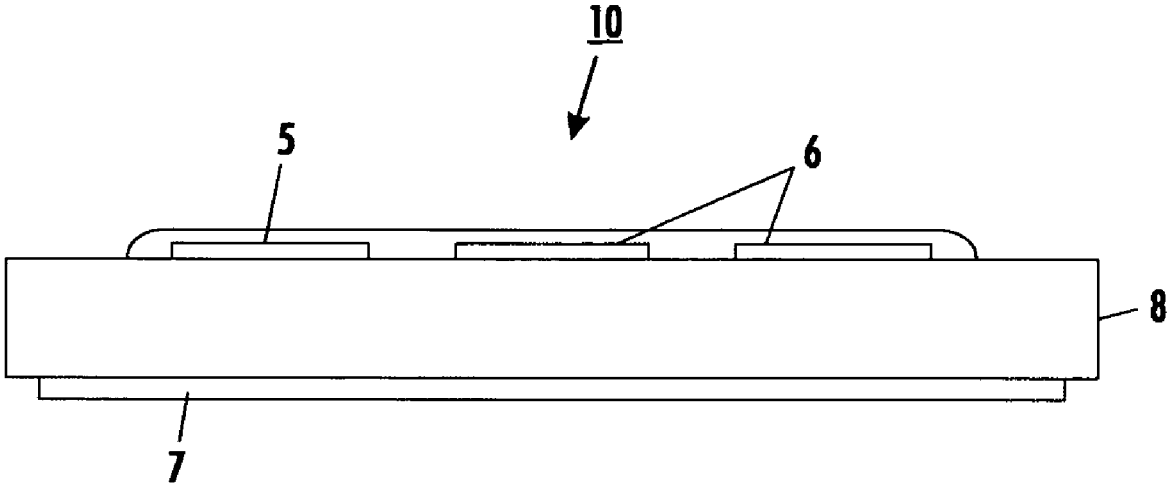
FIG. 4 is an enlarged schematic cross sectional view of the fuser belt in accordance with the present disclosure.

As illustrated in FIG. 4 belt 212 comprises a thermally conductive ceramic substrate layer 8, a low friction coating layer 7, having a conductor/heater interface thereon; conductor 5; resistive traces 6, and ceramic glazing electrical insulation layer 10. Power delivered at the conductors is delivered to the resistive traces causing them to heat up. The heat is then transferred through the thermally conductive ceramic substrate and the low friction coating layer to the belt. The resistive traces are electrically isolated by the ceramic glazing.

In recapitulation, there has been provided a multi-tap heater element design which is a simple, cost effective method to control temperatures of a ceramic element both inside and outside the paper path. The multi-tap heater element design is extremely flexible to application demands. It can be designed for any number of segment lengths, can be used in center and edge registered printers, and for short edge feed and long edge feed printers. The multi-tap heater element design segments can have different power ratings which can be tailored to demand. In addition to demand, segments could be designed in such a way as to maximize energy savings.

The multi-tap heater element controls all segments of the heater at a temperature set point even though there is non-uniform power demand across the entire element. The heater is therefore segmented into regions of a desired length based on perceived power demand. To control these segments individually, each segment has a common supply or return path at one end, and a supply or return path that intersects (tapped into) the element trace, defining the circuit. Each segment region now has a circuit path that can be switched according to demand; this demand is monitored by a thermistor. The temperature signal from the thermistor for each segment is fed to a control logic and switching logic. The control logic may consist of a power control algorithm, for example, a PID.

The switching logic may control which relay closes to activate a segment circuit. The switching algorithm may use a hierarchy strategy to determine which element needs power. Each subsequent element includes on the last one, and the whole element will be powered by the last relay. Sensing temperature drop in smallest segment is controlled at the relay to the smallest segment. Sensing temperature drop in smallest and next segment is controlled at the relay to the next segment, etc. Sensing temperature drop in any segment is controlled at the relay to the entire element. This also ensures that only one relay is closed at a time. Different design configurations could use a different strategy.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A printing machine adapted to print an image on a plurality of different predefined sized sheets, comprising:

means for selecting a sheet of a predefined size to be imaged;

means for recording image;

means for developing the image;

means for transferring the image on said sheet; and a fuser for fusing the image onto said sheet, said fuser includes an endless belt having at least one heating element with a plurality of predefined sized fusing areas being selectively operatable, and wherein said plurality of predefined sized fusing areas are arranged in a substantially parallel manner along a process direction of said belt; and means for activating one or more of said plurality of predefined sized fusing areas to correspond to one of said selected predefined sized sheet.

2. The printing machine of claim 1, wherein said heating element comprises a ceramic heater.

3. The printing machine of claim 2, wherein said heating element has a common resistive element including a plurality of voltage input taps along the length of said common resistive element wherein each of said plurality of predefined sized fusing areas is associated with one of said plurality of voltage input taps.

4. The printing machine of claim 3, wherein said plurality of voltage input taps correspond to each one of said plurality of different predefined sized sheets.

5. The printing machine of claim 3, further including a power supply for supplying a voltage to each one of said plurality of voltage input taps.

6. The printing machine of claim 3, further comprising a temperature controller for controlling temperature in each of said plurality of predefined sized fusing areas.

7. The printing machine of claim 6, wherein said temperature controller includes a plurality of temperature sensors associated with each of said plurality of predefined sized fusing areas.

8. The printing machine of claim 7, wherein said temperature controller selectively activates one or more of said plurality of predefined sized fusing areas in response to said plurality of temperature sensor to maintain a constant temperature in one of said predefined sized fusing areas.

9. The printing machine of claim 8, wherein said temperature controller includes a plurality of thermistors for controlling power regulation associated with each of said plurality of predefined sized fusing areas.

10. A printing machine adapted to print an image on a plurality of different predefined sized sheets, comprising:

means for selecting a sheet of a predefined size to be imaged;

means for recording image;

means for developing the image;

means for transferring the image on said sheet;

a fuser for fusing the image onto said sheet, said fuser includes an endless belt having a plurality of predefined sized fusing areas being selectively operable, and wherein said plurality of predefined size using areas are arranged in a substantially parallel manner along a process direction of said belt, said plurality of predefined sized fusing areas have a common resistive element having a plurality of voltage input taps along the length of said common resistive element; and a power supply for supplying each one of said plurality of voltage input taps a different predefine voltage.

11. A fuser for fusing developed images onto a plurality of different predefined sized sheets, said fuser, comprising:

an endless belt having a heating element with a plurality of predefined sized fusing areas being selectively operatable, and wherein said plurality of predefined sized fusing areas are arranged in a substantially parallel manner along a process direction of said belt; and means for activating one or more of said plurality of predefined sized fusing areas to correspond to one of said plurality of different predefined sized sheets.

12. The fuser of claim 11, wherein said plurality of predefined sized fusing areas comprises a ceramic heater.

13. The fuser of claim 12, wherein said plurality of predefined sized fusing areas have a common resistive element for output voltage and a plurality of voltage input taps along the length of each of said plurality of heating elements.

14. The fuser of claim 13, wherein said plurality of voltage input taps correspond to each one of said plurality of different predefined sized sheets.

15. The fuser of claim 13, further including a power supply for supplying a voltage to each one of said plurality of voltage input taps.

16. The fuser of claim 13, further comprising a temperature controller for controlling temperature in each of said plurality of predefined sized fusing areas.

17. The fuser of claim 13, wherein said temperature controller includes a plurality of temperature sensors associated with each of said plurality of predefined sized fusing areas.

18. The fuser of claim 17, wherein said temperature controller selectively activates one or more of said plurality of predefined sized fusing areas in response to said plurality of temperature sensor to maintain a constant temperature in one of said predefined sized fusing areas.

19. The fuser of claim 18, wherein said temperature controller includes a plurality of thermistors for controlling power regulation associated with each of said plurality of predefined sized fusing areas.

20. A fuser for fusing developed images onto a plurality of different predefined sized sheets, said fuser, comprising:

an endless belt having a plurality of predefined sized fusing areas being selectively operable, and wherein said plurality of predefined sized fusing areas are arranged in a substantially parallel manner along a process direction of said belt said plurality of predefined sized fusing areas have a common resistive element and a plurality of voltage input taps along the length of said common resistive element;

means for activating one or more of said plurality of predefined sized fusing areas to correspond to one of said plurality of different predefined sized sheets, said activating means includes a power supply for supplying each one of said plurality of voltage input taps a different predefine voltage.

* * * * *